US011484101B2

(12) United States Patent
Ng

(10) Patent No.: US 11,484,101 B2
(45) Date of Patent: Nov. 1, 2022

(54) DEVICE FOR FORMING BRUNNIAN LINKS

(71) Applicant: Choon's Design LLC, Farmington Hills, MI (US)

(72) Inventor: Cheong Choon Ng, Novi, MI (US)

(73) Assignee: CHOON'S DESIGN LLC, Farmington Hills, MI (US)

( * ) Notice: Subject to any disclaimer, the term of this patent is extended or adjusted under 35 U.S.C. 154(b) by 0 days.

(21) Appl. No.: 16/990,116

(22) Filed: Aug. 11, 2020

(65) Prior Publication Data

US 2022/0049385 A1 Feb. 17, 2022

(51) Int. Cl.

| | |
|---|---|
| ***A44C 27/00*** | (2006.01) |
| ***D03D 29/00*** | (2006.01) |
| ***D04D 7/04*** | (2006.01) |
| ***B65H 69/04*** | (2006.01) |
| ***D04C 7/00*** | (2006.01) |
| *A44C 5/00* | (2006.01) |

(52) U.S. Cl.

CPC ..... *A44C 27/00* (2013.01); *B65H 69/04* (2013.01); *D03D 29/00* (2013.01); *D04C 7/00* (2013.01); *D04D 7/04* (2013.01); *A44C 5/0069* (2013.01); *A44C 27/001* (2013.01)

(58) Field of Classification Search

CPC ..... D04C 7/00; D03D 29/00; A44C 27/00; B65H 69/04

USPC ..... 289/17

See application file for complete search history.

(56) References Cited

U.S. PATENT DOCUMENTS

| | | | | | |
|---|---|---|---|---|---|
| 2,498,920 | A * | 2/1950 | Holland | A01K 91/04 | 289/17 |
| 2,825,592 | A * | 3/1958 | Semple | B65H 69/04 | 289/17 |
| 3,126,858 | A * | 3/1964 | Rosinski | B63B 21/045 | 114/218 |
| 3,434,750 | A * | 3/1969 | Hetrick | A01K 91/04 | 289/17 |
| 3,476,423 | A * | 11/1969 | Kentfield | B65H 69/00 | 289/17 |
| 3,866,959 | A * | 2/1975 | Matarelli | A01K 97/26 | 289/17 |
| 4,607,869 | A * | 8/1986 | Bersche | A01K 91/04 | 289/17 |
| 5,104,160 | A * | 4/1992 | Cheng | A63H 27/10 | 289/1.5 |
| 5,230,295 | A * | 7/1993 | Shell | B60P 7/0823 | 114/218 |
| 5,562,456 | A * | 10/1996 | Cianciotto | A41D 25/08 | 289/17 |
| 6,412,833 | B2 * | 7/2002 | Lusk | G09B 19/00 | 289/1.5 |
| 7,585,004 | B1 * | 9/2009 | Page | A41D 25/025 | 289/17 |
| 8,141,326 | B2 * | 3/2012 | Wang | A63H 27/10 | 53/284.7 |

(Continued)

*Primary Examiner* — Shaun R Hurley

(74) *Attorney, Agent, or Firm* — Carlson, Gaskey & Olds, P.C.

(57) ABSTRACT

A Brunnian link is a link formed from a closed loop doubled over itself to capture another closed loop to form a chain. Elastic bands can be utilized to form such links in a desired manner. The example loom provides a device for holding elastic bands in place to enable the creation of a Brunnian linked article.

18 Claims, 5 Drawing Sheets

(56) References Cited

U.S. PATENT DOCUMENTS

| | | | | |
|---|---|---|---|---|
| 8,661,624 | B1 * | 3/2014 | Bracewell | B63B 21/08<br>24/129 R |
| 8,931,811 | B1 * | 1/2015 | Ng | A44C 5/0069<br>289/17 |
| 10,667,493 | B2 * | 6/2020 | Blizzard | A01K 27/005 |
| 2001/0030423 | A1 * | 10/2001 | Lusk | G09B 19/00<br>289/17 |
| 2006/0028022 | A1 * | 2/2006 | James, Sr. | A01K 91/047<br>289/17 |
| 2010/0269373 | A1 * | 10/2010 | Pirkle | A43C 7/00<br>36/136 |
| 2014/0319835 | A1 * | 10/2014 | Ng | A44C 27/00<br>289/17 |
| 2015/0042091 | A1 * | 2/2015 | Tommer | A44C 5/02<br>289/1.5 |

* cited by examiner

DEVICE FOR FORMING BRUNNIAN LINKS

BACKGROUND

This disclosure generally relates to method and device for creating a linked item. More particularly, this disclosure relates to a method and device for creating a linked wearable item from elastic bands.

Kits that include materials for making a uniquely colored bracelet or necklace have always enjoyed some popularity. However, such kits usually just include the raw materials such as different colored threads and beads and rely on the individual's skill and talent to construct a usable and desirable item.

SUMMARY

A Brunnian link is a link formed from a closed loop doubled over itself to capture another closed loop to form a chain. Elastic bands can be utilized to form such links. A disclosed loom holds and aligns elastic bands in a relative orientation to enable formation of linked articles.

One disclosed example loom includes a first arm portion spaced apart from a second arm portion and a storage frame portion extending and transverse to the first arm portion and the second arm portion.

In a further embodiment of the foregoing loom, the first arm portion and the second arm portion extend from an upper frame portion that extends parallel to the storage frame portion.

In a further embodiment of any of the foregoing looms, a grip portion extends between the storage frame portion and the upper frame portion on a first side of the loom.

In a further embodiment of any of the foregoing looms the storage frame and the upper frame portion are spaced apart by a storage slot that is open on a second side of the loom.

In a further embodiment of any of the foregoing looms the storage frame includes a first width near the first side that is less than a second width near the second side of the loom.

In a further embodiment of any of the foregoing looms a bottom side of the storage frame includes an indent for holding elastic bands on the storage frame within the storage slot.

In a further embodiment of any of the foregoing looms the storage slot is disposed in the space between the upper frame and the storage frame.

In a further embodiment of any of the foregoing looms each of the first arm portion and the second arm portion include an outer side rib portion and a side tab that expands outward from the outer side rib portion.

In a further embodiment of any of the foregoing looms each of the first arm portion and the second arm portion include a top side rip portion that extends from the outer side rib portion and a top tab that expands outward from the top rib portion.

In a further embodiment of any of the foregoing looms at least one of the first arm portion and the second arm portion includes an opening.

In a further embodiment of any of the foregoing looms the loom is one integral piece.

A kit for making linked articles from elastic bands according to another disclosed embodiment includes, among other possible things, a plurality of elastic bands and a loom including a first arm portion spaced apart from a second arm portion and a storage frame portion extending and transverse to the first arm portion and the second arm portion.

In a further embodiment of the forgoing kit, the first arm portion and the second arm portion extend from an upper frame portion that extends parallel to the storage frame portion and the storage frame and the upper frame portion are spaced apart by a storage slot that is open on a second side of the loom for receiving elastic bands for storage until use.

In a further embodiment of any of the forgoing kits, a bottom side of the storage frame includes an indent for holding elastic bands on the storage frame within the storage slot.

In a further embodiment of any of the forgoing kits, each of the first arm portion and the second arm portion include an outer side rib portion and a top side rib portion, the outer side rib portion including a side tab that expands outward from the outer side rib portion and the top side rip portion includes a top tab that expands outward from the top rib portion.

In a further embodiment of any of the forgoing kits, at least one of the first arm portion and the second arm portion includes an opening.

A method of forming a linked article according to another disclosed example embodiment includes, among other possible things, storing a plurality of elastic bands on a storage frame of a loom, removing at a first elastic band from the storage frame and placing the first elastic band across a first arm portion and a second arm portion, removing a second elastic band from the storage frame and placing the second elastic band across the first arm portion and the second arm portion above the first elastic band, and removing the first elastic band from the first arm portion and the second arm portion while looping onto the second elastic band.

In a further embodiment of the foregoing method, the steps of removing and placing elastic bands is repeated with subsequent elastic bands to form a length of linked elastic bands.

In a further embodiment of any of the foregoing methods, the first elastic band is held and the second elastic band and any subsequent elastic bands are held across the first arm portion and the second arm portion between a top tab and an outer tab.

In a further embodiment of any of the foregoing methods, the length of the linked elastic bands is terminated to form a linked article.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
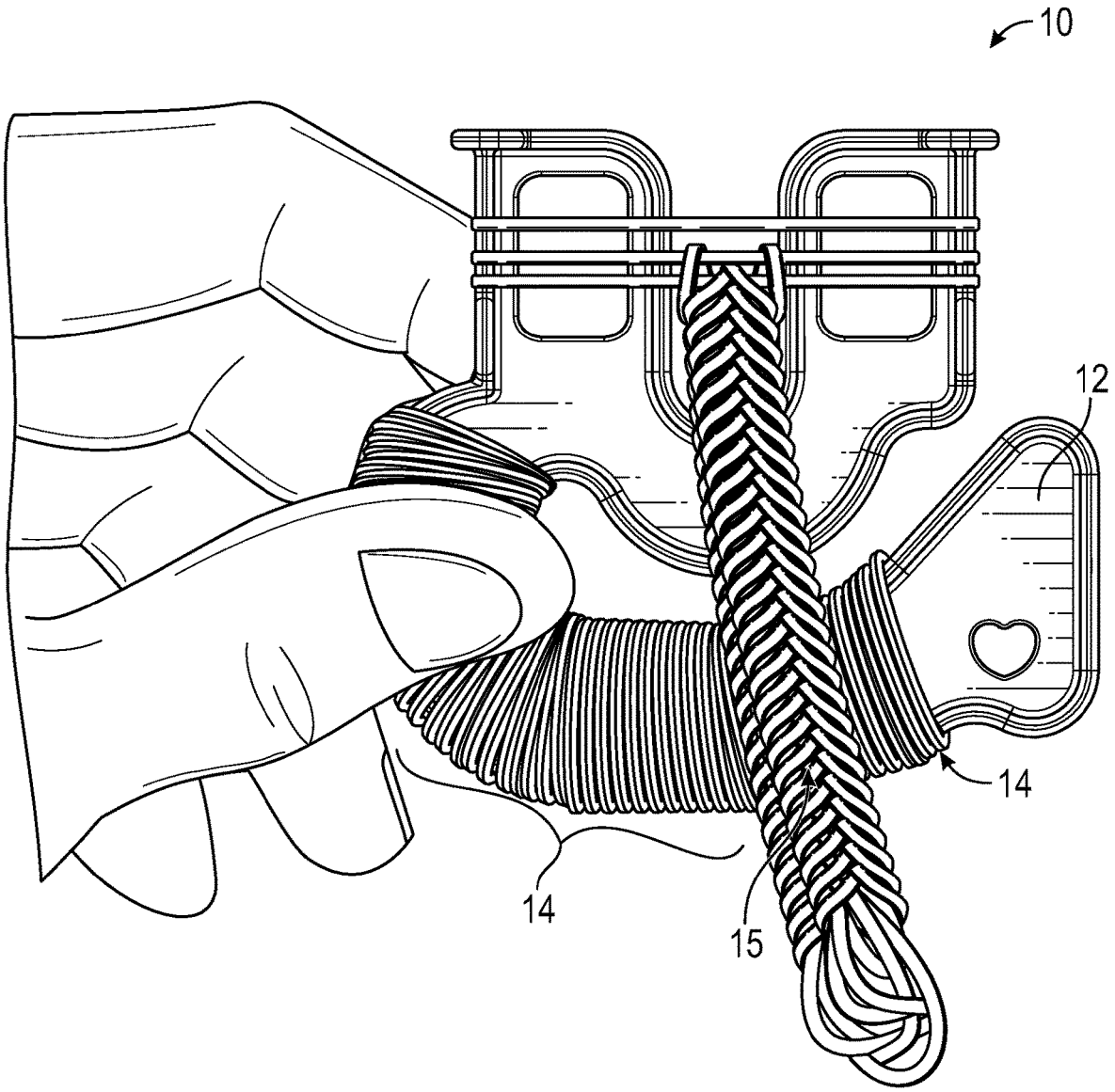
FIG. 1 is a schematic view of an example loom with a portion of linked article.

Referring to FIG. 1 a kit 10 for making a linked article from elastic bands is shown. Elastic bands 14 are supported on a loom 12 that includes features for forming links and for storing the elastic bands 14 when not in use. In this example, the loom provides for linking of the elastic bands in a Brunnian link. A Brunnian link is formed from a continuous looped structure such as the example elastic bands 14 without forming an actual knot. Several elastic bands 14 are linked together with a Brunnian link to form a linked article such as the partially completed linked article 15 shown in FIG. 1. The chain 15 can be fashioned to form a linked article such as a bracelet. Although a partial chain 15 is shown, any number of elastic linked articles can be fabricated and made using the disclosed example loom 12 and are within the scope and contemplation of this disclosure.

Figure 2:
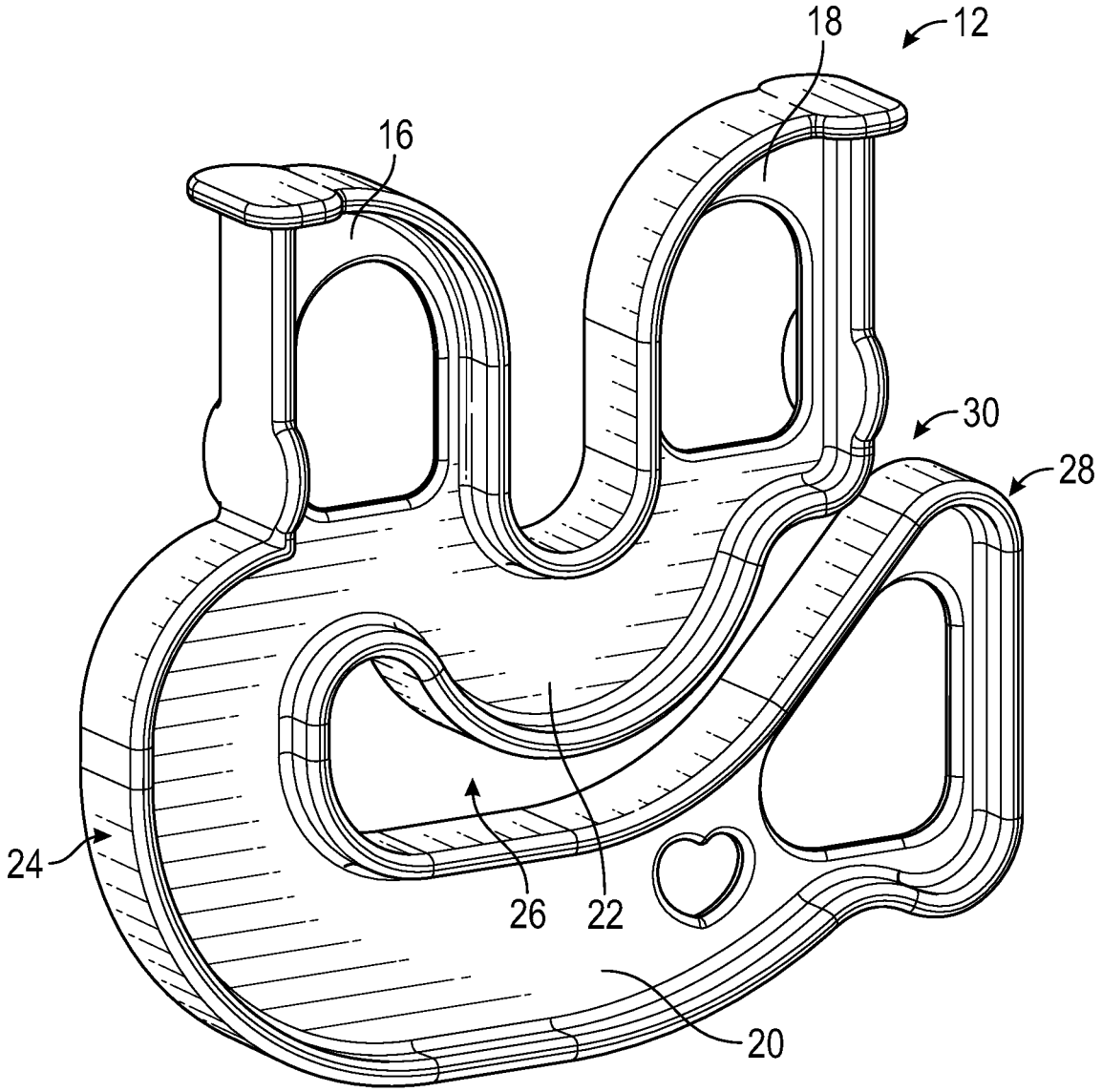
FIG. 2 is a perspective view of an example loom for making linked articles from elastic bands.

Referring to FIG. 2 with continued reference to FIG. 1, the example loom 12 is a one piece integral part with defined portions that facilitate creation of linked articles. Moreover, the example loom 12 includes defined portions for storing elastic bands 14 prior to use in forming a link.

The loom 12 includes a first arm portion 16 spaced apart from a second arm portion 18. A storage frame portion 20 is disposed transverse and below the first and second arm portions 16, 18. The first arm portion 16 and the second arm portion 18 are supported on an upper frame portion 22. A slot 26 is defined in the space between the upper frame portion 22 and the storage frame portion 20. An opening 30 into the slot 26 provides for elastic bands to be wrapped around the storage frame portion 20 and pushed into the slot 26 for holding until needed to form a link. The slot 26 extends from a closed portion on a first side 24 to the opening 30 disposed on the second side 28.

Figure 3:
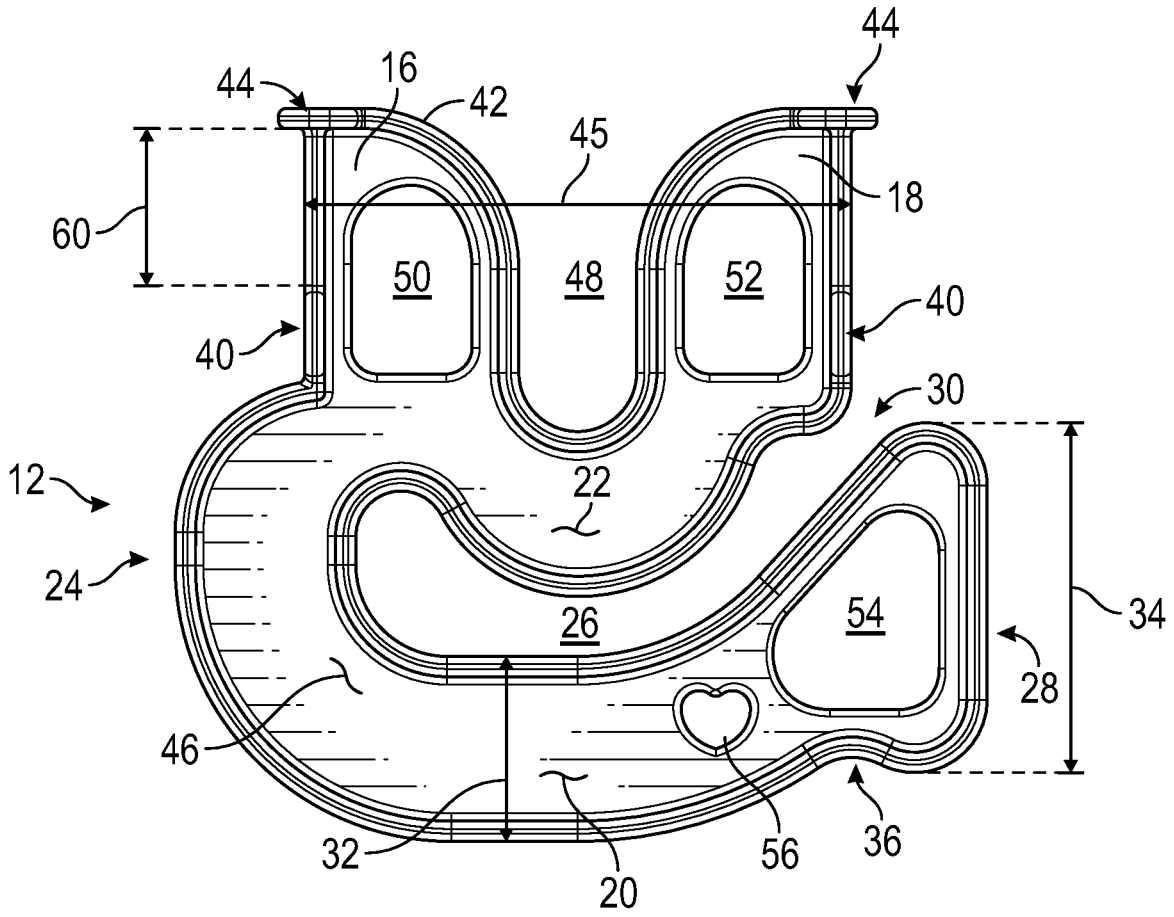
FIG. 3 is a front view of the example loom for making linked articles.
Figure 4:
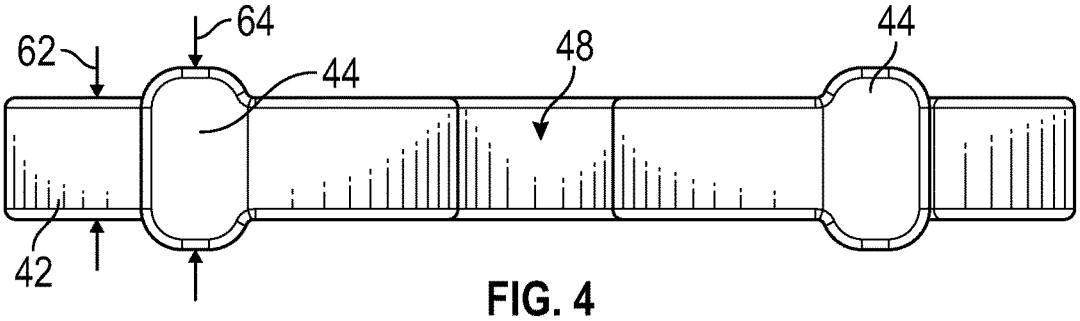
FIG. 4 is a top view of the example loom for making linked articles.
Figure 5:
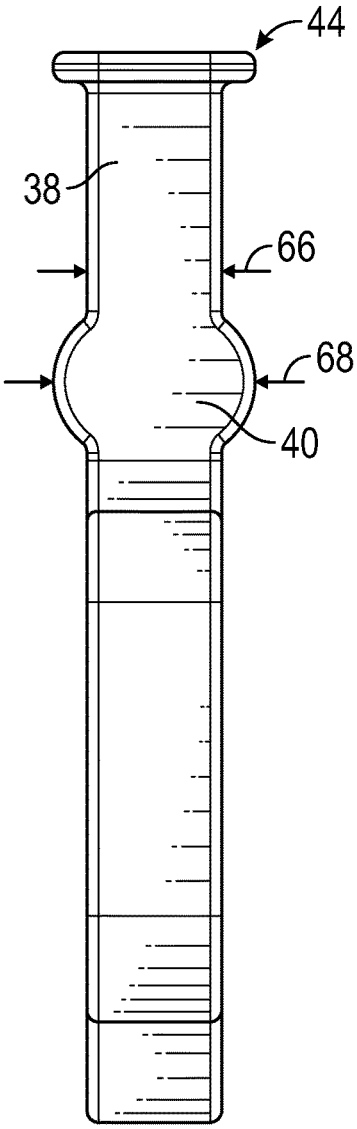
FIG. 5 is a side view of the example loom for making linked articles.

Referring to FIGS. 3, 4 and 5, the first and second arms 16 and 18 are disposed on opposite sides of a space 48. The space 48 provides for the extension of a linked article during fabrication as is shown in FIG. 1. The arm portions 16, 18 include an outer rib 38 that transitions into a top rib 42. The outer rib 38 includes a width 66 that is substantially the same as a width 62 of the top rib 42. The outer rib 38 and the top rib 42 are portions of a continuous rib that extends about an outer periphery of the loom structures. The rib provides a desired rigidity to the loom 12 and also defines features for holding elastic bands in place.

An outer tab 40 expands outward to a width 68 that is greater than the width 66 of the outer rib portion 38. A top tab 44 expands outward from the top rib 42 to a width 64. The width 64 is greater than width 62 of the top rib 42 and substantially the same as the outer tab 40. The top tab 44 and the outer tab 40 are spaced apart a distance 60. The tabs 40, 44 hold elastic bands in place within distance 60 during fabrication of a linked article. The outer tabs 40 hold the elastic bands off the peripheral rib at a bottom region within the distance 60. The top tab 44 holds the elastic bands from slipping off the top of the arms 16, 18.

A first opening 50 is disposed in the first arm 16 and a second opening 52 is disposed in the second arm 18. The openings 50, 52 aid in grasping of elastic bands stretched across the first and second arms 16, 18. As is shown in FIG. 1, when the elastic bands are stretched across the arms 16, 18, the bands extend over the openings 50, 52. The openings 50, 52 provided room for a user's fingers to grasp and pull bands over other bands during fabrication of the linked item.

The upper frame portion 22 transitions into a grip portion 46 and then into the storage frame 20. The grip portion 46 is a smooth curved region that may be utilized to hold the loom 12 during creation of a linked item. The smooth transition in the grip portion 46 further defines the closed end of the slot 26.

The storage frame 20 includes a first width 32 that is less than a second width 34 at the open end 30. The second width 34 provides for holding elastic bands within the slot 26. An indentation 36 is provided along a bottom surface of the storage frame 20 to further prevent elastic bands from slipping out of the slot 26. Although the first width 32 and the second width 34 are called out, the width of the storage frame 20 varies from the closed end to the open end toward the opening 30. The slot 26 also varies with curved surfaces of the upper frame portion 22 and the storage frame portion providing a boundary and shape of the slot 26. The curved surfaces enable the creation of a fanciful appearance to the loom. The curved slot 26 in combination with the shape of the openings 50, 52 evoke an image of a smiley, happy face. The curved lines therefore provide for a desired aesthetic appearance that encourages use.

The storage frame 20 includes an additional opening 54 that provides an additional location for grasping the loom 12. The openings 54 is also shaped in a matter that contributes to the desired appearance. Moreover, a heart shaped opening 56 may also be part of the loom 12 to further contribute and provide a desired attractive and inviting appearance. It should be appreciated that other shapes and openings can be included to generate a desired appearance.

The loom 12 is structured to provide the widths 34 and 32 to hold elastic bands needed to complete an elastically linked article. The widths 34 32 are such that the elastic bands are somewhat expanded, but not so much as to make it difficult to insert or remove. The first and second arms 16, 18, more specifically, outer sides of the first and second arms 16, 18 are spaced apart a distance 45 determined relative to the size of the elastic bands. The spacing is long enough to stretch the bands across the spacing 48, but not so long as to make insertion and removal of the bands difficult or to overly stress the elastic bands.

Figure 6:
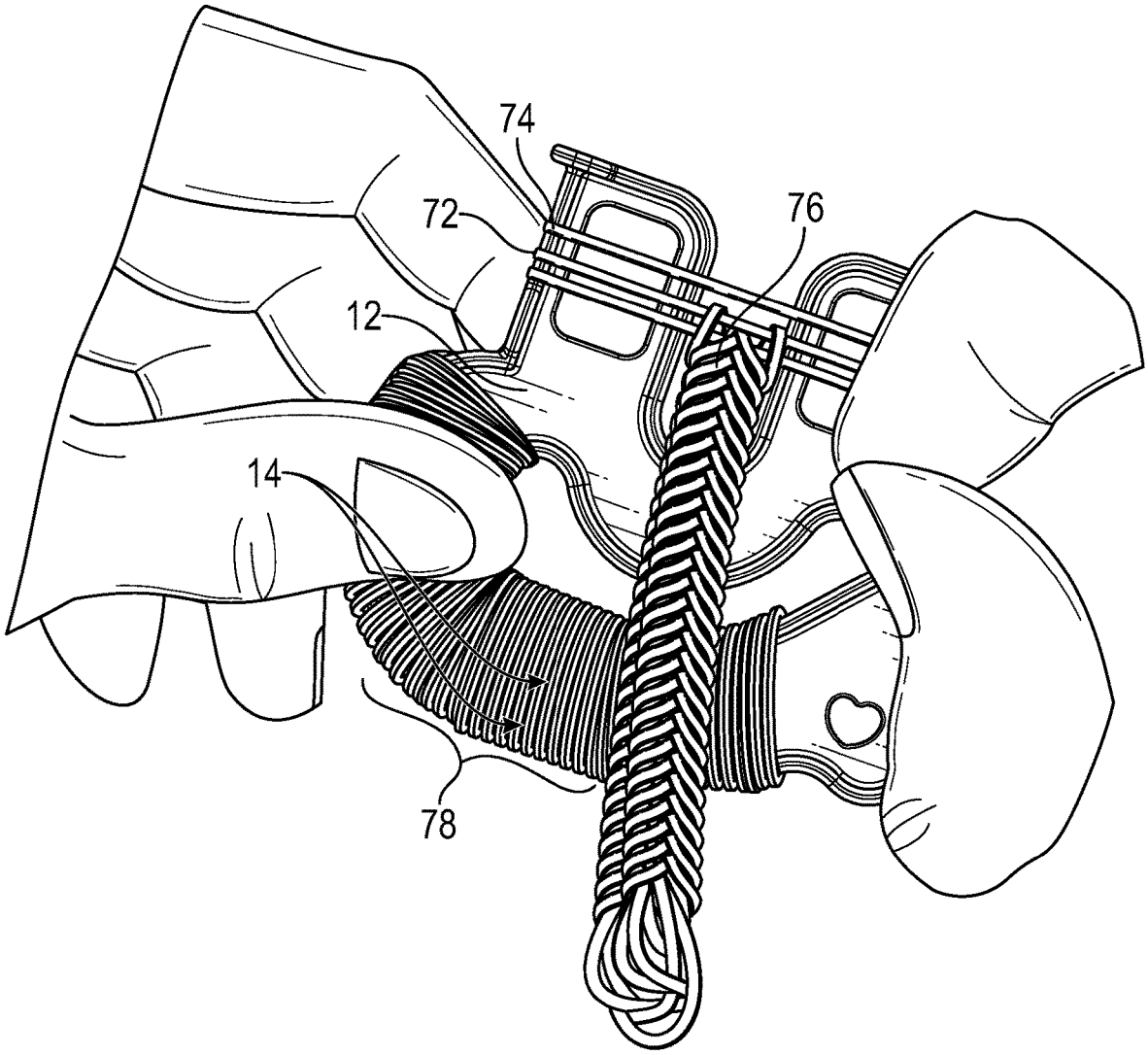
FIG. 6 is view of elastic bands placed across arm portions of example loom in the process of linking elastic bands.

Referring to FIG. 6, with continued reference to FIGS. 3-5, a method of forming a linked article with the example loom 12 is partially shown. The method includes storing a plurality of stored elastic bands 78 on the storage frame 20 of the loom 12. The stored bands 78 are placed on the storage frame 20 by stretching the bands over the width 34 and into the slot 26. Formation of a linked article is started by removing a first elastic band 72 from the storage frame 20 and placing the first elastic band 72 across the first arm portion 16 and the second arm portion 18. With the first elastic band 72 held in place, a second elastic band 74 is removed from the storage frame 22 and placed across the first and second arm portions 16, 18 above the first elastic band 72 within the spacing 60 between the top tab 44 and the outer tab 40

A first link is formed by pulling the first elastic band 72 from the arms 16, 18 and over looping it over the second elastic band 74. The first band 72 then hangs down within the space 48. Additional bands 14 are placed across the arms 16, 18 and the process of pulling a lower band over an upper band is repeated with subsequent elastic bands to form a length of linked elastic bands. Variations of this method can be utilized to form different links. For example, a lower most band could be pulled over two or more upper elastic bands to provide a more intricate link structure. The color of the bands can be selected to provide a desired appearance. Once a desired length is obtained, the ends of the linked article 76 are terminated. The ends could be clipped together to form a bracelet or other linked article. It should be appreciated, that many different possible combinations and linked articles can be made using the disclosed loom 12 and is limited only by the skill and imagination of a user.

Accordingly, the example kit and method provide for the creation of many different combinations and configurations of Brunnian links for the creation of bracelets, necklaces, and other linked items. Moreover, the example kit is expandable to further create and expand the capabilities of potential Brunnian link creations. The example kit provides for the creation of such links and items in an easy manner allowing persons of varying skill levels to be successful in creating unique wearable items.

Although an example embodiment has been disclosed, a worker of ordinary skill in this art would recognize that certain modifications would come within the scope of this disclosure. Moreover, no part of disclosure is intended, either explicitly or implicitly, as any disclaimer or narrowing of claim scope. The description of any one embodiment is not intended, either explicitly or implicitly, as limiting the plain and ordinary meaning set out in the following claims. The example embodiment is only one of many possible structures and methods that are properly within the scope of this disclosure. For that reason, the following claims should be studied to determine the scope and content of this disclosure.

What is claimed is:

1. A loom comprising:

a first arm portion spaced apart from a second arm portion; and a storage frame portion extending transverse to the first arm portion and the second arm portion, wherein the first arm portion and the second arm portion extend from an upper frame portion that extends parallel to the storage frame portion and each of the first arm portion and the second arm portion include an outer side rib portion and a side tab that expands outward from the outer side rib portion.

2. The loom as recited in claim 1, including a grip portion that extends between the storage frame portion and the upper frame portion on a first side of the loom.

3. The loom as recited in claim 2, wherein the storage frame portion and the upper frame portion are spaced apart by a storage slot that is open on a second side of the loom.

4. The loom as recited in claim 3, wherein the storage frame portion includes a first width near the first side that is less than a second width near the second side of the loom.

5. The loom as recited in claim 4, wherein a bottom side of the storage frame portion includes an indent for holding elastic bands on the storage frame within the storage slot.

6. The loom as recited in claim 5, wherein the storage slot is disposed in the space between the upper frame portion and the storage frame portion.

7. The loom as recited in claim 6, wherein each of the first arm portion and the second arm portion include a top side rib portion that extends from the outer side rib portion and a top tab that expands outward from the top rib portion.

8. The loom as recited in claim 1, wherein at least one of the first arm portion and the second arm portion includes an opening.

9. The loom as recited in claim 1, wherein the loom is one integral piece.

10. A kit for making linked articles from elastic bands, the kit comprising:

a plurality of elastic bands; and a loom including a first arm portion spaced apart from a second arm portion and a storage frame portion extending and transverse to the first arm portion and the second arm portion, wherein the first arm portion and the second arm portion extend from an upper frame portion that extends parallel to the storage frame portion and the storage frame portion and the upper frame portion are spaced apart by a storage slot that is open on a second side of the loom for receiving elastic bands for storage until use.

11. The kit as recited in claim 10, wherein a bottom side of the storage frame portion includes an indent for holding elastic bands on the storage frame within the storage slot.

12. The kit as recited in claim 11, wherein each of the first arm portion and the second arm portion include an outer side rib portion and a top side rib portion, the outer side rib portion including a side tab that expands outward from the outer side rib portion and the top side rip portion includes a top tab that expands outward from the top rib portion.

13. The kit as recited in claim 12, wherein at least one of the first arm portion and the second arm portion includes an opening.

14. A loom comprising:

a first arm portion spaced apart from a second arm portion; and a storage frame portion extending transverse to the first arm portion and the second arm portion, wherein each of the first arm portion and the second arm portion include a side tab that expands outward from the corresponding one of the first arm portion and the second arm portion, wherein the first arm portion and the second arm portion extend from an upper frame portion that extends parallel to the storage frame portion and the storage frame portion and the upper frame portion are spaced apart by a storage slot that is open on a second side of the loom for receiving elastic bands for storage until use.

15. The loom as recited in claim 14, wherein the first arm portion and the second arm portion extend from an upper frame portion that extends parallel to the storage frame portion.

16. The loom as recited in claim 14, wherein each of the first arm portion and the second arm portion include a top side rib portion that extends from an outer side rib portion and a top tab that expands outward from the top rib portion.

17. The loom as recited in claim 14, wherein each of the first arm portion and the second arm portion include an outer side rib portion and the side tab expands outward from the outer side rib portion.

18. The loom as recited in claim 17, wherein each of the first arm portion and the second arm portion includes a top tab that extends outward from the corresponding one of the first arm portion and the second arm portion.

* * * * *